US006059267A

United States Patent [19]

Nishimura

[11] Patent Number: 6,059,267

[45] Date of Patent: May 9, 2000

[54] LEVER HOIST

[75] Inventor: Yosaku Nishimura, Osaka, Japan

[73] Assignee: Vital Kogyo Kabushiki Kaisha, Osaka, Japan

[21] Appl. No.: 09/208,027

[22] Filed: Dec. 9, 1998

[30] Foreign Application Priority Data

Jul. 7, 1998 [JP] Japan ..... 10-191510

[51] Int. Cl.[7] ..... B66D 3/14

[52] U.S. Cl. ..... 254/352; 192/95; 254/369

[58] Field of Search ..... 254/352, 353, 254/368, 369; 192/95

[56] References Cited

U.S. PATENT DOCUMENTS 5,156,377 10/1992 Nishimura ..... 254/352

5,575,457 11/1996 Inoue et al. ..... 254/352

5,769,398 6/1998 Samejima ..... 254/352

*Primary Examiner*—Katherine A. Matecki

*Attorney, Agent, or Firm*—Vedder, Price, Kaufman & Kammholz

[57] ABSTRACT

A hoist is a hoisting device wherein a pressure receiving member 6 rigidly secured to a drive shaft 5 is rotated by a press drive member 7 through a reverse rotation stop ring 10 and a pair of friction members 8,9 disposed on both sides of said stop ring. The member 7 is formed with a spring-loading hole 71 opening at the axially base side for accepting the tip 13*d* of a left hand coil spring 13 and a second engaging groove 7*e* opening at the axially base side extending radially outwardly. The groove 7*e* is inclined in the wind-down direction as it approaches the axially forward surface. The angle α formed between the wind-down directional inclined surface 7*k* of said groove 7*e* and the axially backward surface 7*j* of said member 7 is an acute angle.

3 Claims, 4 Drawing Sheets

LEVER HOIST

BACKGROUND OF THE INVENTION

1. Field of the Invention

The present invention relates to a lever-type hoist and more particularly to a lever-type hoist which is capable of instant idling without resort to manipulating an operating wheel for initiation of idling.

2. Description of the Related Art

As a lever-type hoist, the present applicant previously proposed one disclosed in Japanese Patent Kokai H10-59689.

The above lever-type hoist is a hoisting device wherein a pressure receiving member rigidly secured to a drive shaft is rotated by a press drive member through a reverse rotation stop ring and a pair of friction members disposed on both sides of said stop ring, with a left hand coil spring being interposed between said pressure receiving member and said press drive member as a unit to apply a biasing torque in the direction releasing the pressing force of the press drive member on the pressure receiving member.

Now, said pressure receiving member is formed with an axially forwardly opening boss hole and said boss hole is formed with a radially outwardly extending rectangular first engaging groove. Furthermore, as shown in FIG. 6, said press drive member A is formed with a spring loading hole B opening at the axially base side and the spring loading hole is formed with a second engaging groove C extending radially outward. Therefore, the base end portion of the coil spring is inserted into the boss hole with its base end engaging portion engaged with the first engaging groove of the pressure receiving member, and the tip end portion of the coil spring is inserted into the spring loading hole with its tip end engaging portion E of the coil spring D engaged with the second engaging groove of the press drive member.

However, in the case of the conventional hoist, both the angle formed between the wind-up side surface of the first engaging groove and the axially forward surface of the pressure receiving member and the angle formed between the wind-down side of the second engaging groove and the axially backward surface of the press drive member are a right angle. For instance, FIG. 7 illustrates a section of the second engaging groove C of the press drive member A and as shown, the angle formed between the wind-down side C1 of the second engaging groove and the axially backward surface F of the press drive member is a right angle.

Thus, in the conventional hoist, since said angles are made a right angle or more than 90°, the base end engaging portion or the tip end engaging portion formed at each end of the coil spring is sometimes located at the tip of the engaging surface. Therefore, there is a fear that since said each engaging portion of the coil spring is disengaged from said tip of the engaging surface when an impact is applied to an operating handle, etc., a counterclockwise rotational force of the spring does not apply to the press drive member and the lever-type hoist cannot run idle.

The present invention has been made to overcome the above-mentioned disadvantages.

SUMMARY OF THE INVENTION

The lever-type hoist of the present invention comprises a drive shaft connected at its base end to a load sheave through a transmission gear series a pressure receiving member rigidly secured to said drive shaft, a press drive member threaded onto an axially forward part of said pressure receiving member in such a manner that it may travel forward and backward and can be rotated by means of an operating handle when necessary, a reverse rotation stop ring interposed between said pressure receiving member and said press drive member and rotatable in a wind-up direction only, a pair of friction members disposed on both sides of said reverse rotation stop ring in such a manner that they may be pressed by said press drive member, a left hand coil spring interposed between said pressure receiving member and press drive member with both ends being bent radially outwardly to form a base engaging portion and a tip engaging portion, characterized in that: said pressure receiving member is provided with an axially forwardly opening boss hole for receiving the base end portion of said coil spring, said boss hole being formed with a radially outwardly extending first engaging groove which opens at the axially forward side of said boss, said press drive member is formed with a spring-loading hole opening at the axially base side for receiving the tip end portion of said coil spring and a second engaging groove extending radially outwardly opening at the axially base side, said second engaging groove is inclined in the wind-down direction as it approaches the axially forward surface, the angle formed between the wind-down directional inclined surface of said second engaging groove and the axially backward surface of said press drive member is an acute angle, said first engaging groove is formed in the pressure receiving member and engaged with the base engaging portion of the coil spring to arrest rotation of the coil spring in the wind-up direction with respect to the pressure receiving member, and said second engaging groove is formed in the press drive member and engaged with the tip engaging portion of the coil spring to arrest rotation of the press drive member in the wind-up direction with respect to the coil spring.

The present invention is further characterized in that, in addition to the above construction, said first engaging groove is inclined in the wind-up direction as it approaches the axially backward surface and the angle formed between the wind-up directional inclined surface of said first engaging groove and the axially forward surface of said pressure receiving member is an acute angle.

The present invention is further characterized in that, in addition to the above construction, said press drive member is formed with a plurality of units of said second engaging grooves.

In the lever-type hoist according to the present invention, at least the wind-down side surface of the second engaging groove which is formed integrally with the press drive member and engages the tip engaging portion of the left hand coil spring is inclined, and preferably in addition to this construction, the wind-up side surface of the first engaging groove which is formed integrally with the pressure receiving member and engages the base engaging portion of the coil spring is also inclined. And the angle formed between the wind-down directional inclined surface of the second engaging groove and the axially backward surface of the press drive member is an acute angle, that is, an angle less than 90°, and preferably in addition to said angle, the angle formed between the wind-up directional inclined surface of the first engaging groove and the axially forward surface of the pressure receiving member is also such angle .

Thus, the tip engaging portion and the base engaging portion bent radially outwardly at both ends of the coil spring are inserted into the first engaging groove and the second engaging groove respectively, and are not disengaged thereafter. Therefore, the lever-type hoist can be used in continuous good condition.

DETAILED DESCRIPTION OF THE PREFERRED EMBODIMENTS

The lever-type hoist of the present invention is now described in detail.

Figure 1:
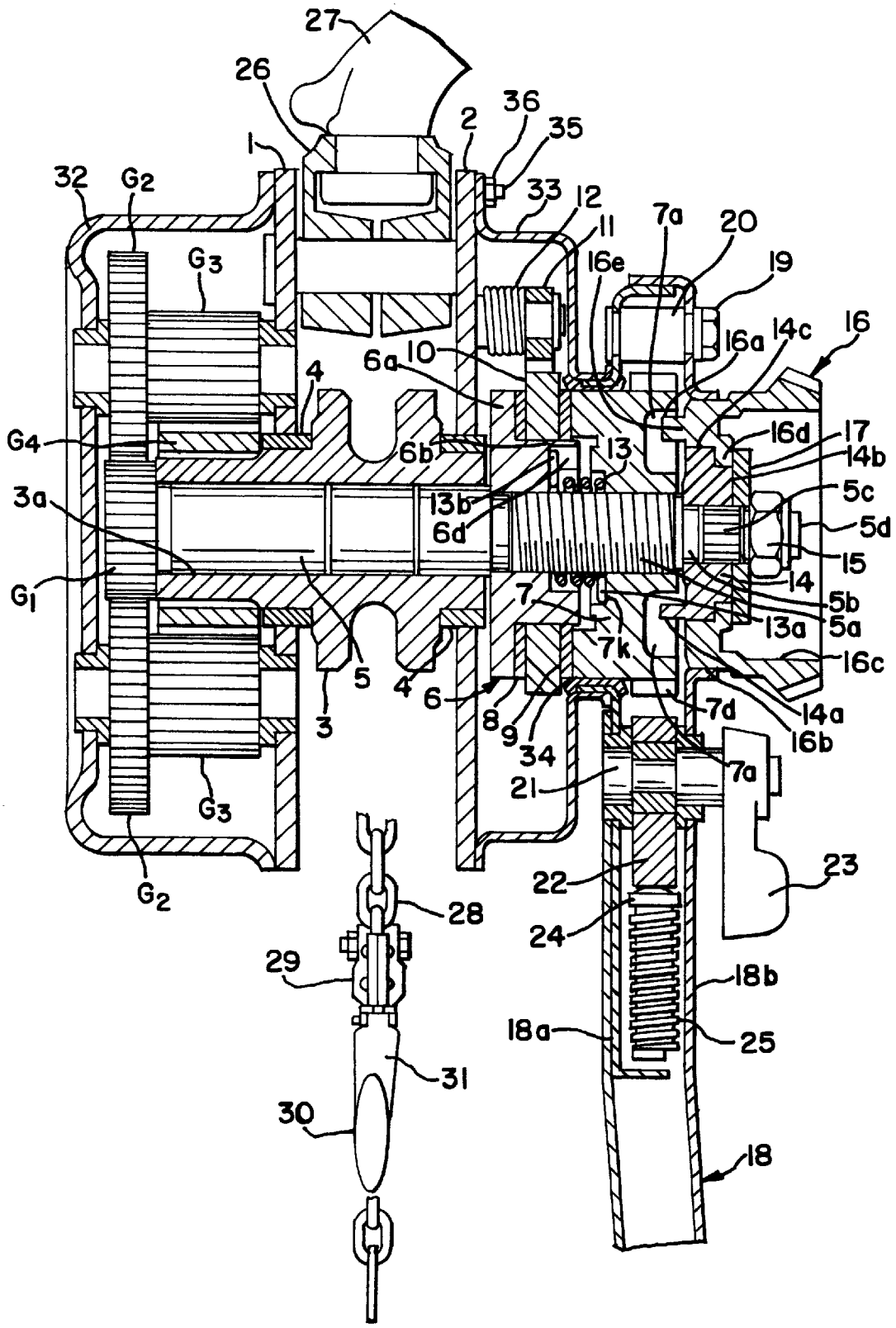
FIG. 1 is a longitudinal section view of a lever-type hoist embodying the principles of the invention.
Figure 2:
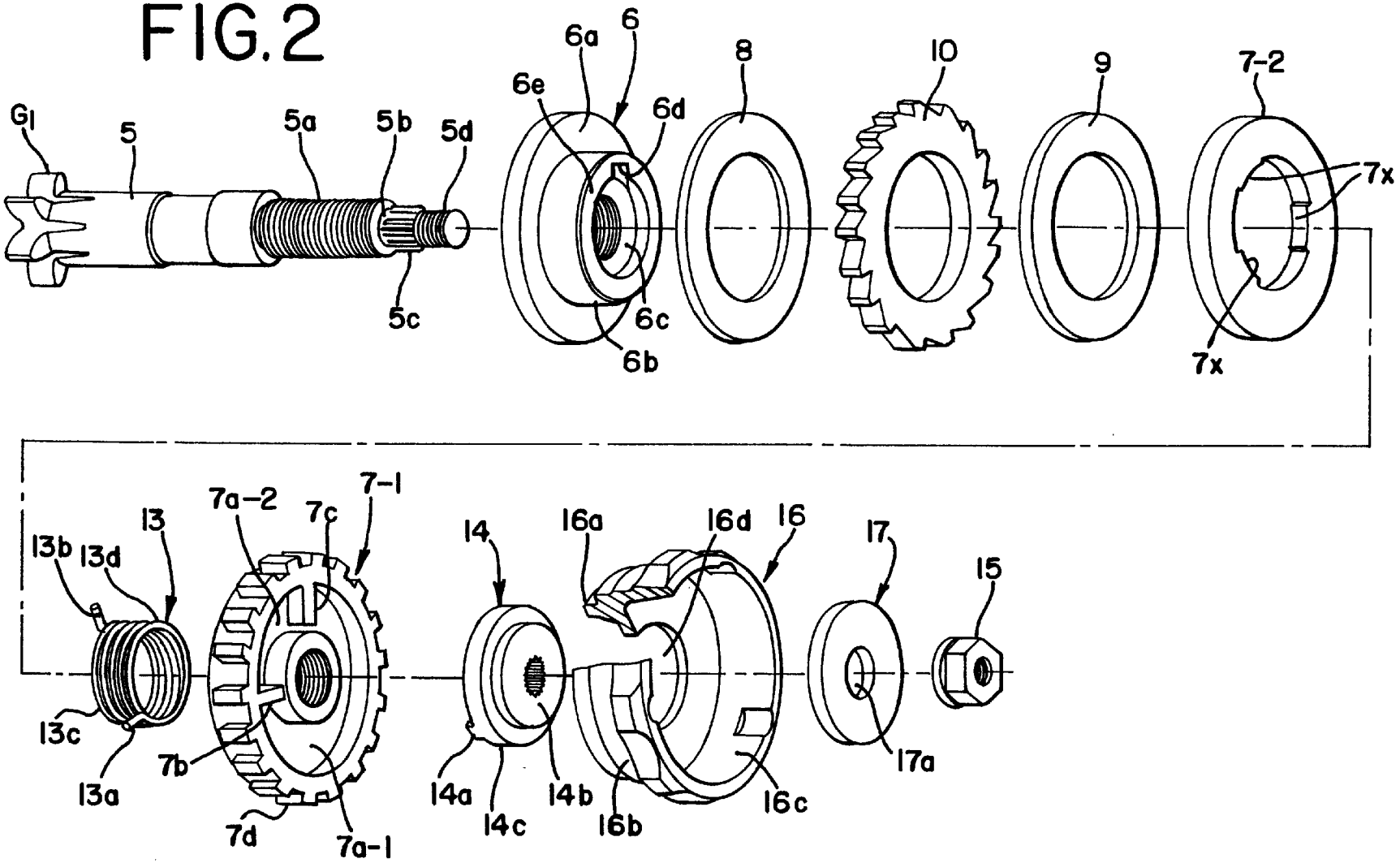
FIG. 2 is a disassembled perspective view of the cardinal elements of a lever-type hoist illustrated in FIG. 1.

FIG. 1 is a longitudinal section view of a lever-type hoist embodying the principles of the invention and FIG. 2 is a disassembled perspective view of the cardinal elements of a lever-type hoist embodying the principles of the invention.

Referring to FIG. 1, a load sheave 3 interposed between a pair of side plates 1, 2 disposed in parallel with a predetermined spacing is journaled by means of bearings 4, 4. The load sheave 3 is formed with a shaft hole 3*a* extending through its center and a drive shaft 5 is rotatably accommodated in this hole 3*a*. Both ends of the drive shaft 5 extend from the corresponding sides of the load sheave 3.

The right-hand extension of the drive shaft 5 is provided with a means for driving the load sheave 3. This extension is formed, in the following order reckoning the side closer to the side plate 2 as the base end and the farther or right-hand side as the forward end, with a first threaded portion 5*a*, a shaft portion 5*b*, a spline portion 5*c*, and a second threaded portion 5*d*. The threaded portions 5*a*, 5*d* are both right-hand or clockwise-threaded. Rigidly mounted on the left-hand extension of the drive shaft 5 is a pinion gear $G_1$ which is coupled to the load sheave 3 through a reduction gear series $G_2$, $G_3$, $G_4$. The gears $G_1$–$G_4$ are covered with a cover 32 attached to the side plate 1.

Mounted in mesh with the first threaded portion 5*a* of the drive shaft 5 are a pressure-receiving member 6 and a press-drive member 7 in the order of increasing distance from the side plate 2, and the pressure-receiving member 6 has been screwed into the innermost part of the first threaded portion 5*a* and fixedly secured in position.

This pressure-receiving member 6 has a disk portion 6*a* and a boss portion 6*b*. While the disk portion 6*a* is disposed adjacent to the side plate 2, the boss portion 6*b* is designed to project toward the axially forward side from the center of the disk 6*a*. The boss portion 6*b* of pressure-receiving member 6 is formed with a boss hole 6*c* having a diameter somewhat larger than the outer diameter of a left hand coil spring 13, which is open in the axially forward direction. In addition, a part of the circumferential wall defining the boss hole 6*c* is formed with a first engaging groove 6*d* which extends axially from the axially forward surface 6*e* to the bottom or innermost end of the boss hole 6*c*. Sleeved over said boss 6*b* are a pair of friction members 8, 9 and, as interposed there-between, a reverse rotation stop ring 10.

Figure 3:
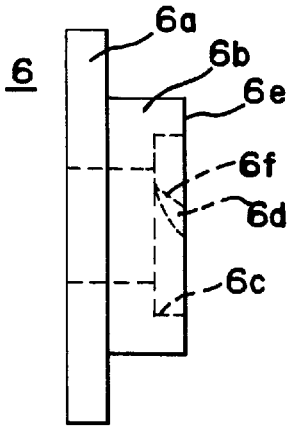
FIG. 3 is a plan view showing a pressure receiving member of the lever-type hoist illustrated in FIG. 1.
Figure 4:
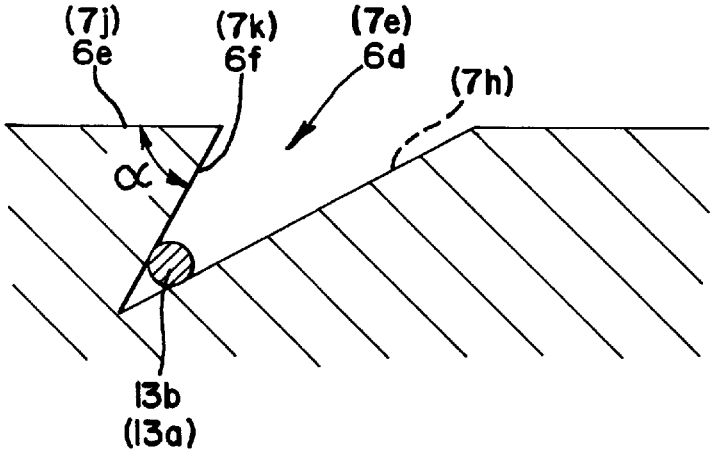
FIG. 4 is a sectional view showing a first engaging groove or a second engaging groove of the lever-type hoist illustrated in FIG. 1.

FIG. 3 is a plan view of a pressure receiving member 6 and FIG. 4 is a sectional view of a first engaging groove 6*d* of a pressure receiving member 6.

As shown in FIG. 3, the first engaging groove 6*d* is formed in substantially V-shape inclined in the wind-up direction as it approaches the axially base surface. In addition, the angle $\alpha$ formed between the wind-up side 6*f* of the first engaging groove 6*d* and the axially forward surface 6*e* of the pressure receiving member 6 is an acute angle as shown in FIG. 4. While said angle $\alpha$ is about 60° degrees as illustrated, it may be any angle less than 90°.

The outer periphery of said reverse rotation stop ring 10 is formed with engaging teeth inclined in one circumferential direction. It is so designed that the reverse rotation stop ring 10 and the friction members 8, 9 disposed on both sides thereof are pressed together by the press-drive member 7 so that they are sandwiched as a unit between the disk portion 6*a* of pressure-receiving member 6 and the press-drive member 7.

A ratchet pawl 11 is pivotally supported by the side plate 2 and biased by a coil spring 12 against the outer periphery of the reverse rotation stop ring 10. This ratchet pawl 11 is engaged by the engaging teeth of the reverse rotation stop ring 10 so that the reverse rotation stop ring 10 may rotate exclusively in the wind-up direction of the load sheave 3.

While the press-drive member 7 thread-coupled onto the first threaded portion 5*a* for optionally forward or backward movement may be an integral unit as illustrated in FIG. 1, it may be formed as two discrete elements, namely a body 7-1 and a pressure plate 7-2 as shown in FIG. 2.

Figure 5:
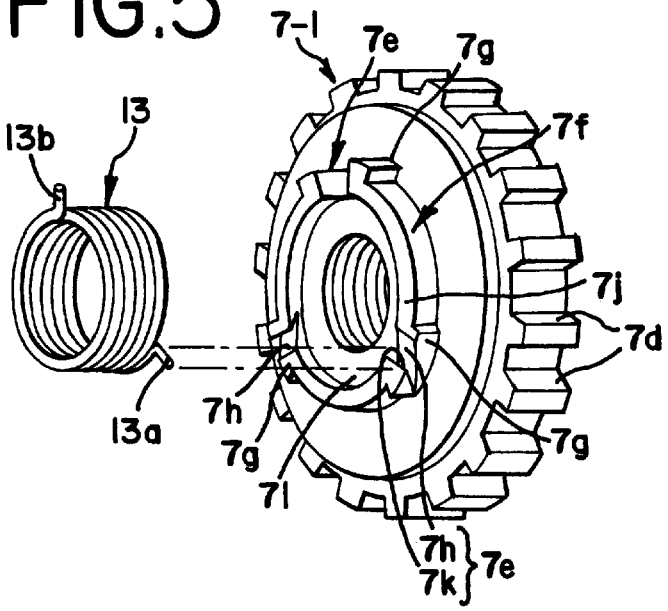
FIG. 5 is a perspective view of a press-drive member and a left hand coil spring, as viewed from the axially base direction, of the lever-type hoist illustrated in FIG. 1.
Figure 6:
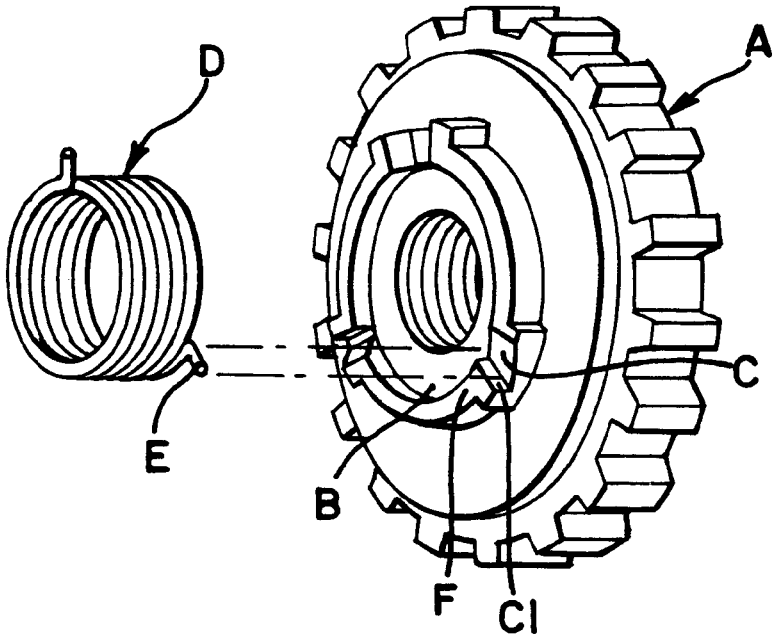
FIG. 6 is a perspective view of a press drive member and a coil spring, as viewed from the axially base direction, of a conventional lever-type hoist.
Figure 7:
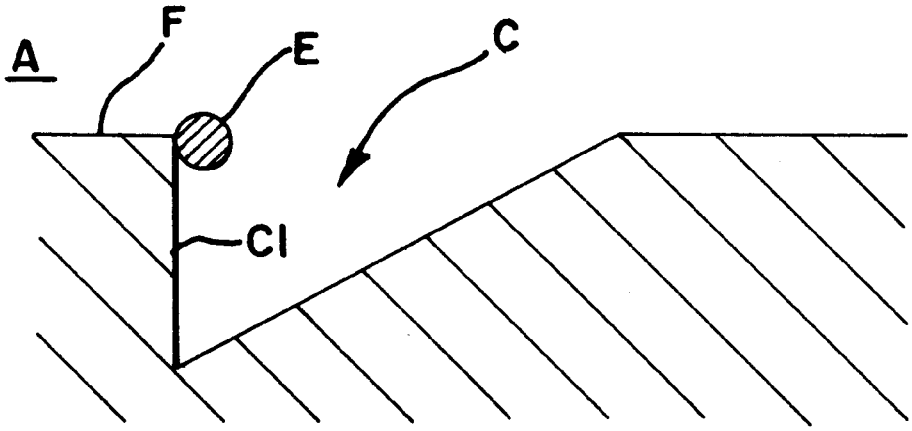
FIG.7 PRIOR ART
FIG. 7 is a sectional view showing a second engaging groove of a conventional lever-type hoist.

FIG. 5 is a perspective view, as viewed from the axially base side, of the body 7-1 of the press-drive member 7.

According to the embodiment wherein said press-drive member 7 is formed as two discrete elements, viz. body 7-1 and pressure plate 7-2, the increased-diameter projections 7*g* formed integrally with a boss-shaped projection 7*f* of the body 7-1 are disposed between reduced-diameter projections 7*x* formed integrally with the pressure plate 7-2 and the increased-diameter projections 7*g* are abutted against the reduced diameter portions 7*x*, whereby the body portion 7-1 and the pressure plate 7-2 act as a unit. In addition, the geometric relation between the increased-diameter portion 7*g* of body 7-1 and the reduced-diameter projection 7*x* of pressure plate 7-2 permits slight relative rotation of body 7-1 and pressure plate 7-2, with the result that even if the pressure plate 7-2 is caused to sink into the friction member 9, this biasing (sinking) force of pressure plate 7-2 on the friction members etc. can be released by applying an impact force to the pressure plate 7-2 using the operating wheel 18.

The press drive member 7 is formed with an annular recess 7*a* on the axially forward side thereof and this annular recess 7*a* is provided with a first projection 7*b* and a second projection 7*c*, both extending radially, whereby the annular recess 7*a* is divided into two sectors 7*a*-1 and 7*a*-2 which are widely different in central angle as illustrated in FIG. 2.

The axially backward side surface of the body 7-1 of the press drive member 7 is formed with an annular projection 7*f* projecting in the axially backward direction.

This annular projection 7*f* is designed to project in concentric annular shape with a threaded bore formed in a radial center portion of the body 7-1, and its circumferential wall is formed with at least one second engaging groove 7*e* for engaging a forward end engaging portion 13*a* of a left hand coil spring 13. In the illustrated embodiment, three such second engaging grooves 7*e* are disposed at equal intervals of 120 degrees. The inside of said annular projection 7*f* constitutes a left hand coil spring loading hole 71 of an inner diameter approximating the outer diameter of the coil spring 13.

Each second engaging groove 7*e* is formed in substantially V-shape from the axially backward side surface 7*j* toward the axially forward side of said annular projection 7*f* in such a manner that its tip end portion inclines in the wind-down direction as it approaches the axially forward surface. A sectional shape of the second engaging groove 7*e* is generally equal to that of the first engaging groove 6*d* formed integrally with the pressure receiving member 6 and as shown in FIG. 4, the wind-up directional inclined surface 7*h* is inclined slightly more slowly against the axially backward surface 7*j* than the wind-down directional inclined surface 7*k* in extended axially forward direction. Therefore, the tip engaging portion 13*a* of the left hand coil spring 13 is engaged with the bottom portion of the second engaging groove 7*e* formed at the intersection of the inclined surfaces 7*h*,7*k*. The axial depth of the second engaging groove 7*e* corresponds to the level of the bottom of spring-loading hole 71. The circumferential side wall where the second engaging groove 7*e* is formed extends radially outwardly to form an increased-diameter projection 7*g*.

The pressure plate 7-2 of press drive member 7 is in the form of a short cylinder with the its inner diameter being slightly larger than the diameter of said increased-diameter projection 7*g* of body 7-1. In addition, the inner-diameter surface of pressure plate 7-2 is formed with radially inwardly projecting reduced-diameter projections 7*x*, the diameter of which is larger than the diameter of the annular projection 7*f* of body 7-1 and smaller than the diameter of said increased-diameter projection 7*g*.

Fitted to a spline 5*c* of the drive shaft 5 is a rotation-restricting member 14 in adjacency to the press drive member 7. The rotation-restricting member 14 is formed with a rotation-limiting projection 14*a* on its side facing the press drive member 7, while the opposite side of said rotation-limiting member 14 is formed with a boss 14*b* projecting out in the axial direction.

Positioning of the rotation-restricting member 14 with respect to the press drive member 7 is carried out by, for example, engaging the rotation-restricting member 14 with the spline 5*c* of the drive shaft 5 in such a manner that with the press drive member 7 having been fully displaced in the wind-up direction to press the friction members 9, the rotation-limiting projection 14*a* will be engaged with the spline 5*c* of drive shaft 5 at an a angle of about 30 degrees in the wind-down direction with respect to the first projection 7*b* of the press drive member 7. In this manner, the rotation-limiting projection 14*a* projecting into the larger annular recess 7*a*-1 is abutted against the first projection 7*b* to thereby inhibit rotation of the drive press member 7 beyond a necessary extent with respect to the drive shaft 5, thus precluding excessive displacement of press drive member 7 in the axially outward direction.

The left hand coil spring 13 is literally left-handed, with its ends being bent radially outwardly to constitute a base end engaging portion 13*b* and a tip engaging portion 13*a*. The opening angle between the base engaging portion 13*b* and tip engaging portion 13*a* of the coil spring 13 can be freely selected, and is about 60–90 degrees in the illustrated embodiment. The coil spring 13 should have a spring force allowing winding-up without undue resistance when the press drive member is driven with a load on the load sheave.

The left hand coil spring 13 is loosely fit over the drive shaft 5 and its base portion 13*c* is passed into a boss hole 6*c* of pressure-receiving member 6 while its tip portion 13*d* is inserted into a spring loading hole 71 of press drive member 7. The left hand coil spring 13 is set with its base engaging portion 13*b* engaged by the first engaging groove 6*d* of the pressure receiving member 6 and its tip engaging portion 13*a* engaged by the second engaging groove 7*e* of the press drive member 7.

In assembling, with the base engaging portion 13*b* of the coil spring 13 fitted in the first engaging groove 6*d* of pressure receiving member 6 and one side portion of the coil spring 13 inserted in the boss hole 6*c*, the press drive member 7 is advanced along the first threaded portion 5*a* of the drive shaft 5, whereby the tip engaging portion 13*a* of the coil spring 13 is automatically engaged into the second engaging groove 7*e* of press drive member 7. Thus, because the depth is increased in the wind-down direction along the wind-up directional inclined surface 7*h*, advancing of the press drive member 7 in the wind-up direction automatically leads the tip engaging portion 13*a* of the coil spring 13 to the bottom of the second engaging groove 7*e* of press drive member 7. Furthermore, it is advantageous to provide a plurality of second engaging grooves 7*e*, for then every several fractions of one revolution of the press drive member 7 in the wind-up direction results in a stop, thus further facilitating engagement with the coil spring 13 and, moreover, the coil spring 13 can be set to the optimum strength.

Because of the above work, the left hand coil spring 13 is tightly engaged by the pressure receiving member 6 with its base engaging portion 13*b* inserted into the bottom of the first engaging groove 6*d*. In addition, the engaging portions 13*a*, 13*b* of the left hand coil spring 13 are inserted into the bottoms of the engaging grooves 7*e*,6*d* respectively by the axial force of the spring 13.

In the above arrangement, as the base engaging portion 13*b* of the coil spring 13 is engaged with the first engaging groove 6*d*, the tip engaging portion 13*a* engaged with the second engaging groove 7*e*, and the press drive member 7 rotated in the wind-up direction, the coil spring 13 is deformed so that a circumferential biasing force acts on the press drive member 7 to screw it back from the pressure receiving member 6 toward the axially forward end. In addition, the press drive member 7 is also subjected not only to a counterclockwise rotational force screwing it back but also to an axial force biasing it axially outwardly against the pressure receiving member 6.

In disassembling the hoist for changing worn parts such as the friction members, the press drive member 7 is rotated in the wind-down direction, whereupon the tip engaging portion 13*a* of the coil spring 13 is disengaged from the second engaging groove 7*e* as sliding on the wind-up directional inclined surface 7*h* so that the press drive member 7 can be continuously rotated in the wind-down direction without interference, thus allowing disassembling to be completed in a short time.

Rotatably mounted on the outer periphery of the boss portion 14*b* of rotation limiting member 14 is an operating wheel 16. This operating wheel 16 is so formed as to be in plane contact with the outer periphery of the rotation restricting member 14 and has a recess 16*c* at its axially forward side. In addition, the outer periphery of the operating wheel 16 is formed with irregularities so as to make it easy to grasp and rotate the wheel 16.

The bottom wall of the operating wheel 16 which faces the press drive member 7 is provided with a pressure release projection 16*a* adapted to fit into the smaller annular recess 7*a*-2 of press drive member 7. The pressure release projection 16*a* is abutted against the second rib 7*c* of the press drive member 7 to rotate the member 7 by inertia or by a force applied in the wind-down direction to thereby displace the press drive member 7 toward the axially forward side.

Fitted in the recess 16*c* of the operating wheel 16 is a washer 17, with the drive shaft 5 piercing through its shaft hole 17*a*, and this washer 17 is rigidly secured to the inner bottom wall of the operating wheel 16 by a nut 15 screwed onto the second threaded portion 5*d* of the drive shaft 5. The outer diameter of the washer 17 is slightly larger than the diameter of the shaft hole 16*d* in the bottom wall of the operating wheel 16. Therefore, even if the operating wheel 16 is pulled outwardly, it will not be disengaged from the rotation restricting member 14, nor will be affected the engagement of the pressure release projection 16*a* with the two projections 7*b*, 7*c*. The rotation restricting member 14 is so formed so that the end face of the boss portion 14*b* will be disposed slightly lower than the inner bottom wall of wheel 16.

The gear 7*d* portion of the press drive member 7 is housed in an operating handle 18.

The operating handle 18 consists of an inner case 18*a* and an outer case 18*b*. The inner case 18*a* is provided with an opening surrounding the friction member 9 side of press drive member 7 and the outer case 18*b* is provided with an opening surrounding the outer periphery of the bottom wall portion 16*b* of operating wheel 16. The inner case 18*a* and outer case 18*b* are connected to each other by a plurality of screws 19, 19, . . . and nuts 20, 20, . . . to form a unit.

The operating handle 18 extends below the press drive member 7 and is internally provided with a rorotational direction switch pawl 22. This rotational direction switch pawl 22 is supported rotatably by a shaft 21 with respect to the two handle cases 18*a*, 18*b*.

The shaft 21 projects out of the operating handle 18 and is fitted with a switch lever 23 at its projecting portion.

Upon switching of this switch lever 23, the rotational direction switch pawl 22 is engaged allowing rotation either in the wind-up (UP) direction or in the wind-down (DOWN) direction, or in neutral position where no rotation can occur in either direction. Abutted against the lower end of the rotational direction switch pawl 22 is a pressure member 24 biased upward by a spring 25, whereby the rotational direction switch pawl 22 is resiliently Supported in a predetermined switch position.

Disposed atop between the two side plates 1, 2 via a connecting metal 26 is an upper hook 27. Connected to the lower end of a load chain 28 taken up on the load sheave 3 via a connecting metal 29 is a lower hook 30 for suspending a load. The reference numeral 31 represents a metal for preventing disengagement of a load, which is pivoted to the top of the lower hook 30 in such a manner that it is rotatable selectively inwardly. Indicated at 33 is a cover attached to the side plate 2 by a plurality of screws 35 and nuts 36. The cylindrical opening in the center of this cover 33 is superposed on the periphery of the cylindrical opening of inner case 18*a* in such a manner that the operating handle 18 may be rotated in both directions.

A cylindrical stopper member 34 with a bracket-like sectional configuration is inserted on the inner side of the cylindrical opening of inner case 18*a* for controlling the axial displacement of the operating handle 18. This cylindrical stopper member 34 is made, for example, of steel.

The operation of the lever-type hoist according to this embodiment is now explained.

For idling, the switch lever 23 is set in neutral position. When the switch lever 23 is set in neutral position, under no load the biasing force of the coil spring 13 causes the press drive member 7 to rotate in the wind-down direction with agility and move axially forwardly along the first threaded portion 5*a* of the drive shaft 5 and away from the friction member 9. As a result, an idling operation can be immediately started by pulling the chain 28 without the need to manipulate the operating wheel 16 for rotation. The press drive member 7 is prevented from being driven further axially forwardly after its first projection 7*b* has been abutted against the rotation limiting projection 14*a* of rotation restricting member 14.

On the other hand, the spring force of the coil spring 13 for idling is so weak that under a load the drive shaft 5 is subjected to a force urging it to turn counterclockwise, i.e. in the hoist-down direction and, in addition, an engaging tooth of the reverse rotation stop ring 10 is in mesh with the ratchet pawl 11 of the ratchet gear. Therefore, the press drive member 7 is rotated in the wind-up direction to press the friction members 8, 9 and reverse rotation stop ring 10 against the pressure receiving member 6 to maintain the braking effect and insure safety.

For hoisting a load up, the switch lever 23 is set to the wind-up (UP) direction in the first place and the operating handle 18 is then turned to and fro about the drive shaft 5. For hoisting down the load, the switch lever 23 is set to the wind-down (DOWN) direction and the operating handle 18 is then rotated to and fro about the drive shaft.

In the lever-type hoist according to the embodiment, the left hand coil spring 13 interposed between the pressure receiving member 6 and press drive member 7 applies a circumferential biasing force to the press drive member 7 so as to separate the press drive member 7 apart from the pressure receiving member 6.

Thus, upon mere setting of the change lever 23 in neutral position, the press drive member 7 is automatically separated from and maintained apart from the pressure receiving member 6. Therefore, an idling operation can be established without resort to manipulating the operating wheel 16.

In addition, as the press drive member 7 is provided with the second engaging groove 7*e*, the coil spring 13 can be set in position by mere threading of the press drive member 7 along the drive shaft 5, with the result that assembling work is facilitated for enhanced productivity.

Furthermore, since the left hand coil spring 13 to be interposed between the pressure receiving member 6 and the press drive member 7 can be set in position without requiring clearances from the respective members, the first engaging groove 6*d* of the pressure receiving member 6 can be positively engaged with the second engaging groove 7*e* of the press drive member 7, with the consequence that there is no risk of the coil spring being disengaged with the pressure receiving member 6 or the press drive member 7 during operation, thus insuring safety.

What is claimed is:

1. A lever hoist comprising a drive shaft connected at its base end to a load sheave through a transmission gear series, a pressure receiving member rigidly secured to said drive shaft, a press drive member threaded onto an axially forward part of said pressure receiving member in such a manner that it may travel forward and backward and can be rotated by means of an operating handle, a reverse rotation stop ring interposed between said pressure receiving member and said press drive member and rotatable in a wind-up direction only, a pair of friction members disposed on both sides of said reverse rotation stop ring in such a manner that they may be pressed by said press drive member, a left hand coil spring interposed between said pressure receiving member and press drive member with both ends being bent radially outwardly to form a base engaging portion and a tip engaging portion, characterized in that:

said pressure receiving member is provided with an axially extending boss surrounding a forwardly opening boss hole for accepting the base engaging portion of said coil spring, said boss hole being formed with a radially outwardly extending first engaging groove opening at an axially forward side of said boss, said press drive member is formed with a spring-loading hole opening at the axially base side for accepting the tip engaging portion of said coil spring and a second engaging groove extending radially outwardly opening at the axially base side, said second engaging groove includes an inclined surface which is inclined in a wind-down direction as it approaches the axially forward surface, an angle formed between the wind-down directional inclined surface of said second engaging groove and the axially backward surface of said press drive member is an acute angle, said first engaging groove is formed in the pressure receiving member and engaged with the base engaging portion of the coil spring to arrest rotation of the coil spring in the wind-up direction with respect to the pressure receiving member, and said second engaging groove is formed in the press drive member and engaged with the tip engaging portion of the coil spring to arrest rotation of the press drive member in the wind-up direction with respect to the coil spring.

2. The lever-type hoist according to claim 1 further characterized in that said first engaging groove includes an inclined surface which is inclined in a wind-up direction as it approaches the axially backward surface and the angle formed between the wind-up directional inclined surface of said first engaging groove and the axially forward surface of said pressure receiving member is an acute angle.

3. The lever-type hoist according to claim 2 further characterized in that said press drive member is formed with a plurality of units of said second engaging grooves.

* * * * *